US006003672A

United States Patent [19]

Chapman et al.

[11] Patent Number: 6,003,672

[45] Date of Patent: Dec. 21, 1999

[54] PACKAGING METHOD AND THE RESULTING PACKAGE FOR A SET OF SNORKELING EQUIPMENT

[75] Inventors: Michael M. Chapman, Trabuco Canyon; John M. Chaffers, Santa Ana, both of Calif.

[73] Assignee: Chapman-Walters Intercoastal Corporation, Huntington Beach, Calif.

[21] Appl. No.: 09/240,534

[22] Filed: Jan. 29, 1999

[51] Int. Cl.[6] ..... B65D 75/00

[52] U.S. Cl. ..... 206/579; 206/5; 206/315.1; 53/445

[58] Field of Search ..... 53/445; 206/5, 206/315.1, 579; 405/185–187, 194

[56] References Cited

U.S. PATENT DOCUMENTS

| | | | |
|---|---|---|---|
| D. 340,131 | 10/1993 | Cassidy, IV | 206/315.1 |
| 3,050,180 | 8/1962 | Huylebroeck et al. | 206/579 |
| 4,919,258 | 4/1990 | Peretta | 206/315.1 |
| 5,433,230 | 7/1995 | Miller | 206/315.1 |
| 5,447,216 | 9/1995 | Freyvogel | 206/315.1 |
| 5,511,666 | 4/1996 | Grip | 206/579 |
| 5,878,443 | 3/1999 | Seiler | 206/5 |

*Primary Examiner*—Jim Foster
*Attorney, Agent, or Firm*—Leonard Tachner

[57] ABSTRACT

A method for packaging a full set of snorkel components and a resulting package. Swim fins are arranged in an overlapping configuration. A mask including its strap, surrounds the two overlapping fins with the mask positioned about halfway between the ends of the fins and facing in the same direction as the foot aperture of the front-facing fin. A snorkel tube is positioned on the edge of the overlapping fins in a direction generally parallel to the length of the fins. The snorkel tube may be attached to the mask strap and the mouthpiece of the snorkel tube is placed between the mask and the foot aperture. This assembled set of snorkel components is placed in a clear plastic, zippered bag having a narrow end and a wider end. An optional cover carton may be added to cap the respective ends of the zippered bag, provide added structural support and provide surfaces for some limited graphics.

13 Claims, 5 Drawing Sheets

PACKAGING METHOD AND THE RESULTING PACKAGE FOR A SET OF SNORKELING EQUIPMENT

BACKGROUND OF THE INVENTION

1. Field of the Invention

The present invention relates generally to the field of snorkel equipment including mask, snorkel tube and swim fins. The invention relates more specifically to a packaging method and the resulting package for a set of such snorkel equipment.

2. Prior Art

Consumers interested in purchasing snorkel gear, normally need to buy all of the basic components one wears when snorkeling. These components are a mask, a snorkel tube (with mouthpiece) and a pair of swim fins. Historically, such components have been sold separately in their individual packages. As a result, it is relatively common for consumers to purchase the mask of one manufacturer, the snorkel tube of another manufacturer, the swim fins of yet another manufacturer and the carrying bag of still a different manufacturer. Even if a consumer wishes to purchase the various components of a single manufacturer, it is common to find these in their own respective packages which, of course, adds to the cost of the products as compared to a form of common packaging of the combined components.

One of the difficulties of packaging the mask, snorkel tube and swim fins in one combined package, is that they are radically different from one another in shape and size, as well as in respective materials. Of course, it is possible to simply divide an ordinary rectangular carton into several disparately sized compartments. However, that brute force approach results in relatively large and unattractive packages which require large and expensive exterior graphics to improve the packaging aesthetics. Moreover, the large package size quickly exhausts shelf-space limitations requiring more frequent deliveries to retailers thus also adding to the cost of the displayed product.

Therefore, it would be highly advantageous to provide a package for an entire set of snorkel equipment (i.e., mask, snorkel tube and swim fins) which package is relatively space efficient, inexpensive, aesthetically pleasing and easily recognized in regard to the snorkel components contained therein and which includes a carrying bag.

SUMMARY OF THE INVENTION

The present invention comprises a method for packaging a full set of snorkel components and a resulting package which is space efficient, attractive, inexpensive and easily recognized as a container of all of the needed components of snorkeling gear, i.e., mask, snorkel tube and swim fins.

In the novel package of the invention herein, the swim fins are arranged in an overlapping configuration, the mask including its strap, surrounds the two overlapping fins with the mask positioned about halfway between the ends of the fins and facing in the same direction as the foot aperture of the front-facing fin. The snorkel tube is positioned on the edge of the overlapping fins in a direction generally parallel to the length of the fins. The snorkel tube may be attached to the mask strap and the mouthpiece of the snorkel tube is between the mask and the foot aperture. This assembled set of snorkel components is placed in a clear plastic, zippered bag having a narrow end and a wider end. An optional cover carton may be added to cap the respective ends of the zippered bag, provide added structural support and provide surfaces for some limited graphics. Between the ends of the zippered bag or carton caps as the case may be, a prospective purchaser sees all of the components of a snorkel set with a mask staring back at him or her in an attention attracting effect, that effect being a snorkel and mask configured as one would be wearing them during snorkeling.

OBJECTS OF THE INVENTION

It is therefore a principal object of the present invention to provide a method of packaging a set of snorkel equipment to reduce overall size, to display all components of the set and to minimize packaging costs.

It is another object of the invention to provide, in combination, a set of snorkel equipment (i.e., mask, snorkel tube and swim fins) and a package therefore, the package providing a space efficient, aesthetically pleasing display and storage device for the set of snorkel equipment.

It is still another object of the invention to provide a package and packaging method for snorkel equipment which results in an overall pleasing appearance which attracts consumer attention and interest.

BRIEF DESCRIPTION OF THE DRAWINGS

The aforementioned objects and advantages of the present invention, as well as additional objects and advantages thereof, will be more fully understood hereinafter as a result of a detailed description of a preferred embodiment when taken in conjunction with the following drawings in which.

DETAILED DESCRIPTION OF A PREFERRED EMBODIMENT

Figure 1:
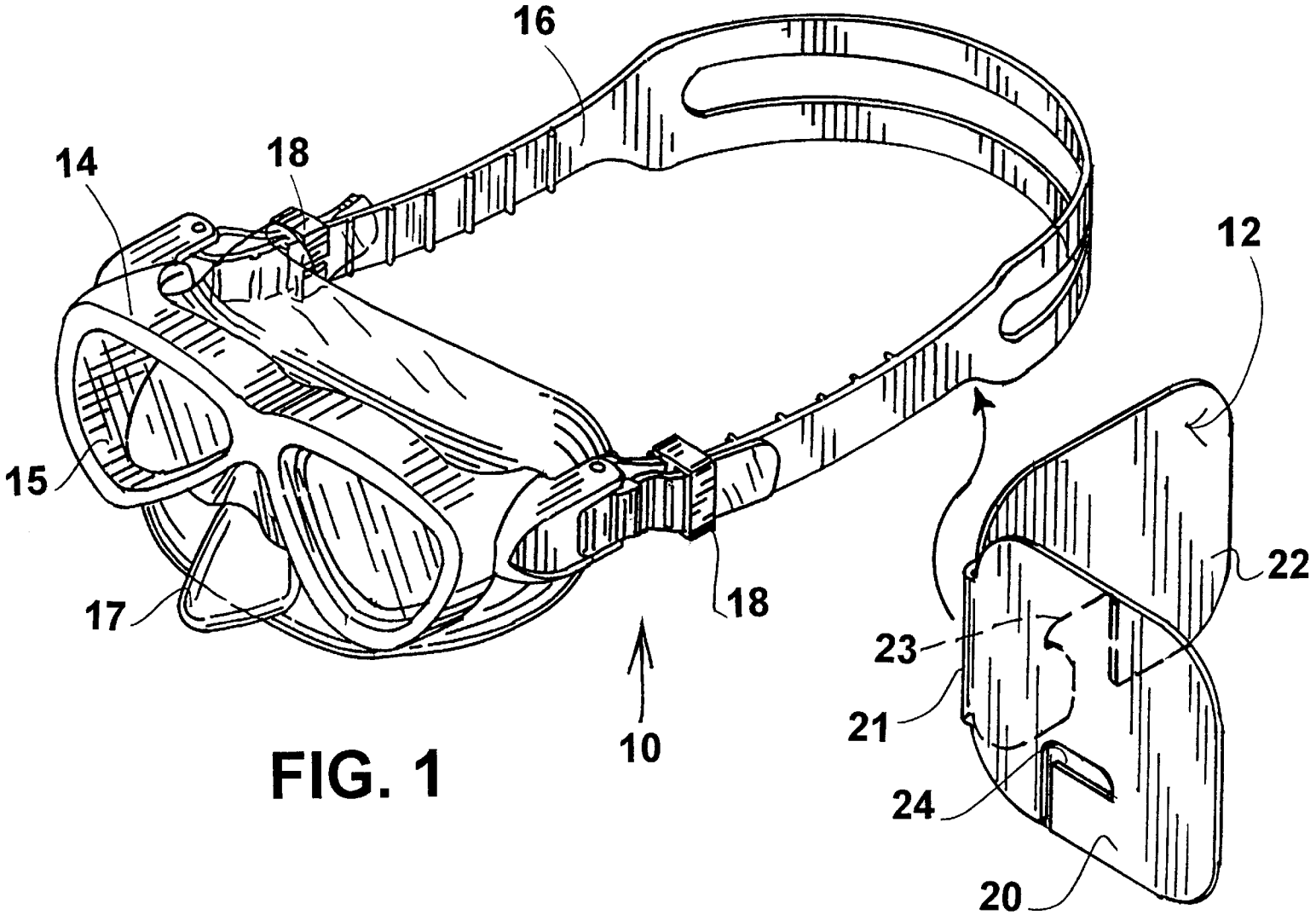
FIG. 1 is a three-dimensional view of a snorkel mask that may be packaged by means of the present invention.

Referring now to the accompanying drawings, it will be seen that one of the components of a set of snorkel equipment comprises a snorkel mask 10. Mask 10 comprises a face portion 14 and a strap 16. Face portion 14 includes a pair of lenses 15 and a nose enclosure 17. Strap 16 includes a pair of strap retainers 18. The present invention also comprises a strap tightener 12 which has a pair of generally rectangular foldable cardboard or plastic flaps 20 and 22 joined at a hinge 21. Flap 20 has a slit 24 and flap 22 has a slot 23. The purpose of tightener 12 is best understood by referring to FIG. 2 where it will be observed that strap 16 is threaded between flaps 20 and 22 which are folded together and retained in that folded configuration by the interconnection of slit 24 and slot 23. In this manner, tightener 12 serves to take up the slack of strap 16 and provide a smaller loop for the packaging method hereof as will be further understood hereinafter.

Figure 2:
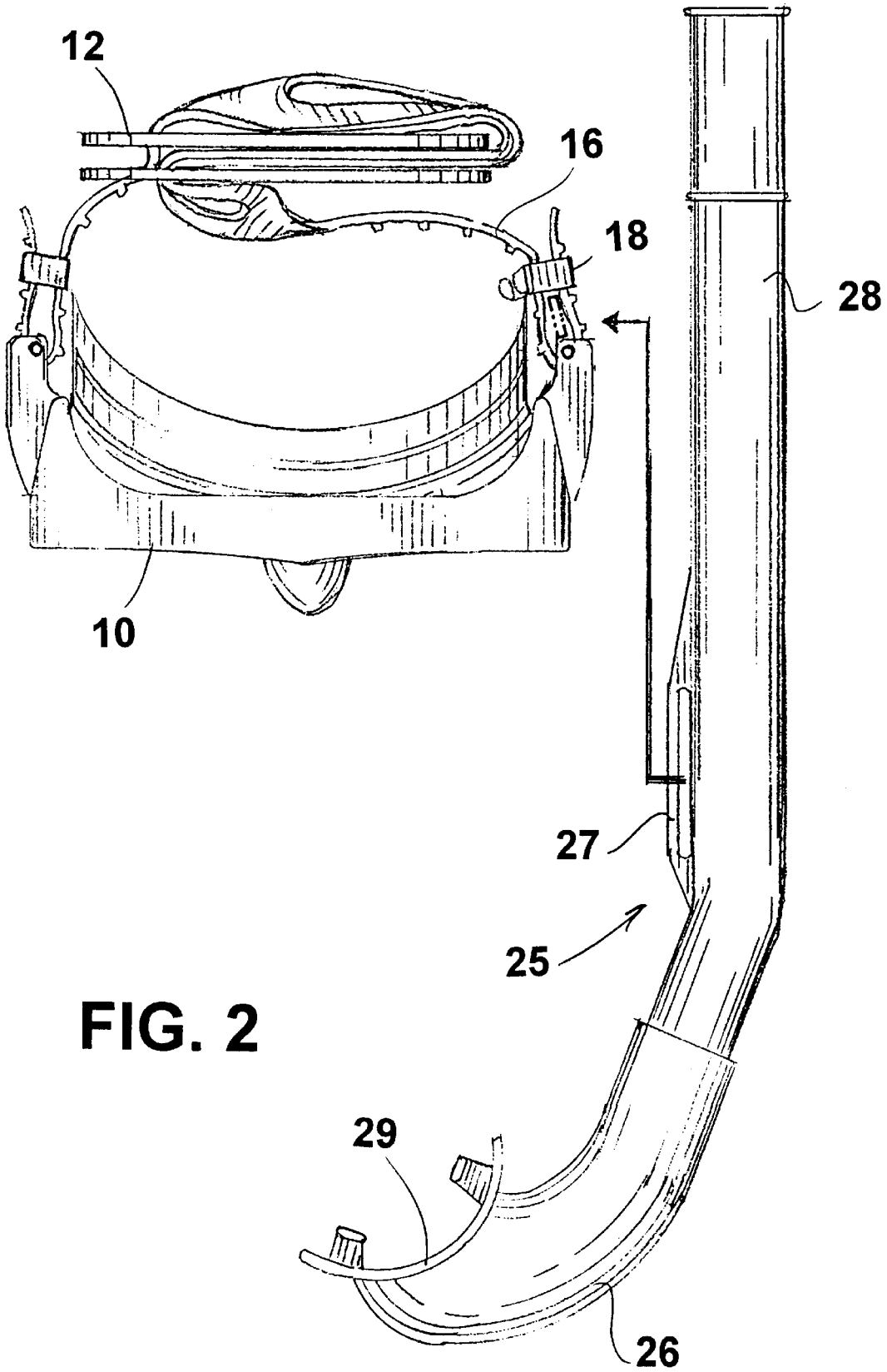
FIG. 2 is a plan view of the mask and snorkel tube that may be packaged in accordance with the invention.

FIG. 2 also illustrates the interconnection of mask 10 with a snorkel tube 25. Snorkel tube 25 comprises a lower portion 26 and an upper portion 28, the latter having a bracket 27 for receiving the mask strap 16.

Figure 3:
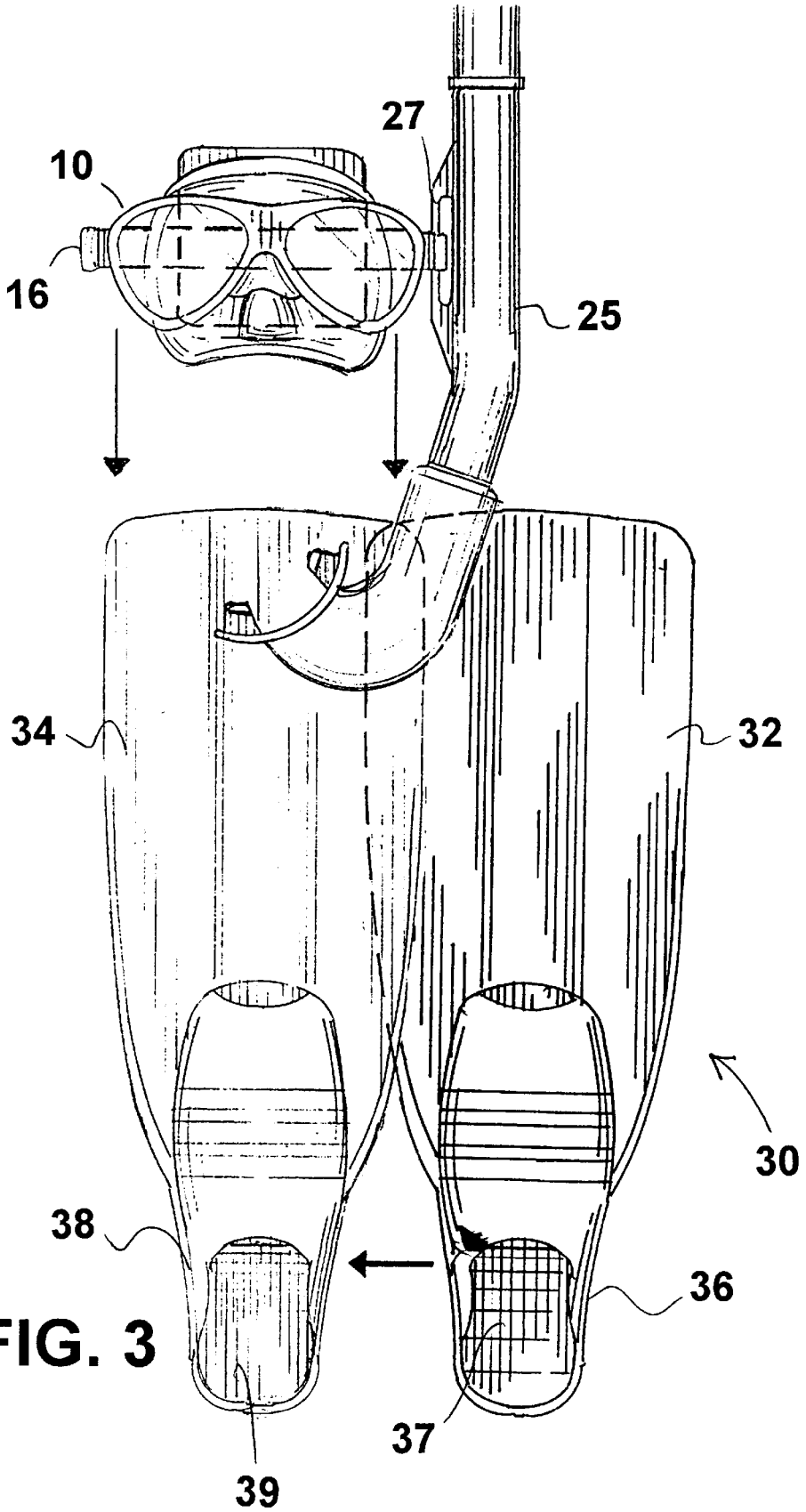
FIG. 3 is an elevational view of the mask, snorkel tube and swim fins that may be packaged in accordance with the invention.
Figure 5:
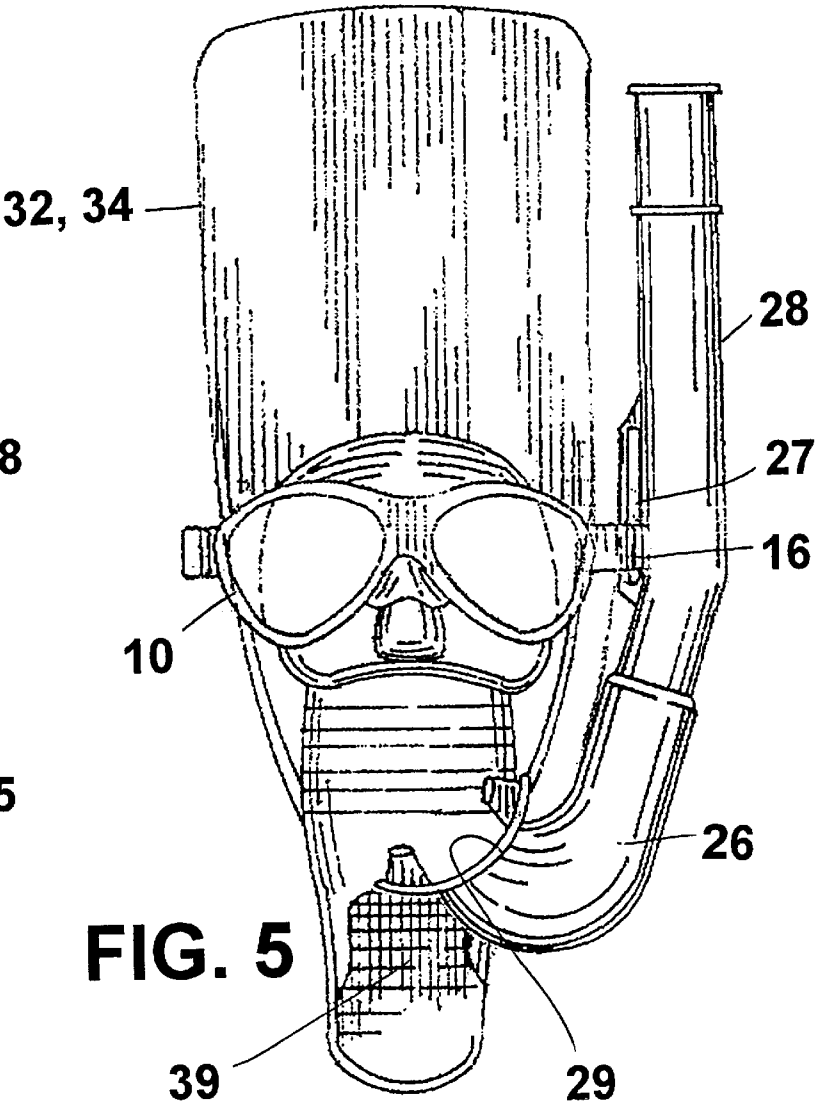
FIG. 5 is an elevational view of the snorkel set components shown interconnected and configured for placement in the package of the invention.
Figure 4:
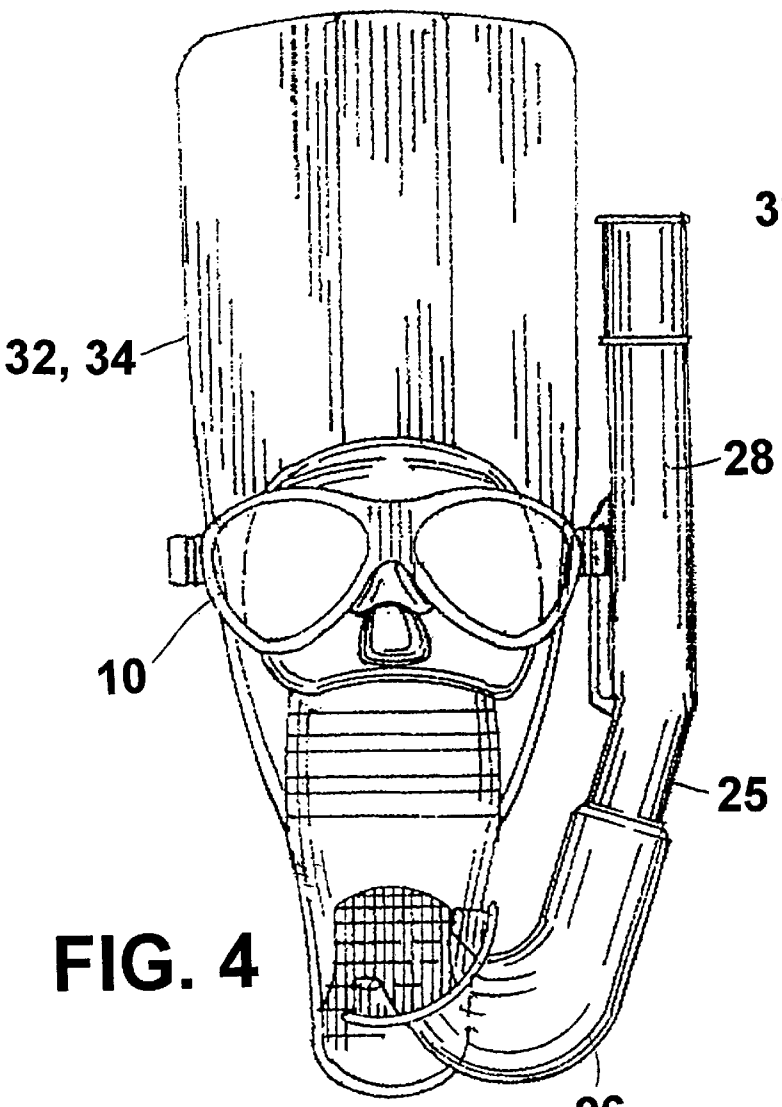
FIG. 4 is an elevational view of the snorkel set components shown interconnected in accordance with the invention.

The method of the invention may be best understood by referring to FIGS. 3–7. In FIG. 3 there is shown a pair of swim fins 30 comprising a right fin 32 and a left fin 34. The fins are positioned in parallel overlapping relation so that their respective foot portions 36 and 38 are aligned and the apertures 37 and 39 face in the same direction. The mask 10 is then positioned on the pair of fins 30 so that lenses 15 are positioned near the toe end of the foot portions 36 and 38 with the mask strap (tightened by strap tightener 12) surrounding the fins 30 in a snug manner to prevent the mask from sliding relative to the fins. The snorkel tube 25 remains affixed to the strap 16 of the mask 10 as shown in the upper portion of FIG. 3. The result of this interconnection of mask 10, snorkel tube 25 and fins 30 is illustrated in FIG. 4. In FIG. 5, the snorkel tube 25 has been translated toward the mask 10 so that mouthpiece 29 is immediately below the nose enclosure 17.

Figure 7:
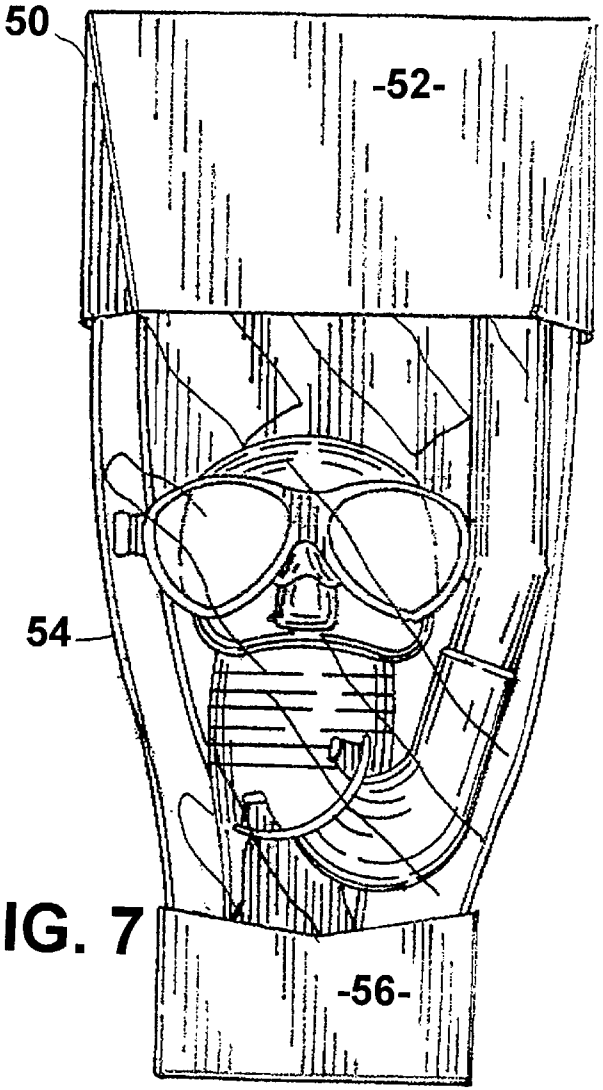
FIG. 7 is a view of the package of FIG. 6 shown with an optional carton for a preferred embodiment of the invention.
Figure 6:
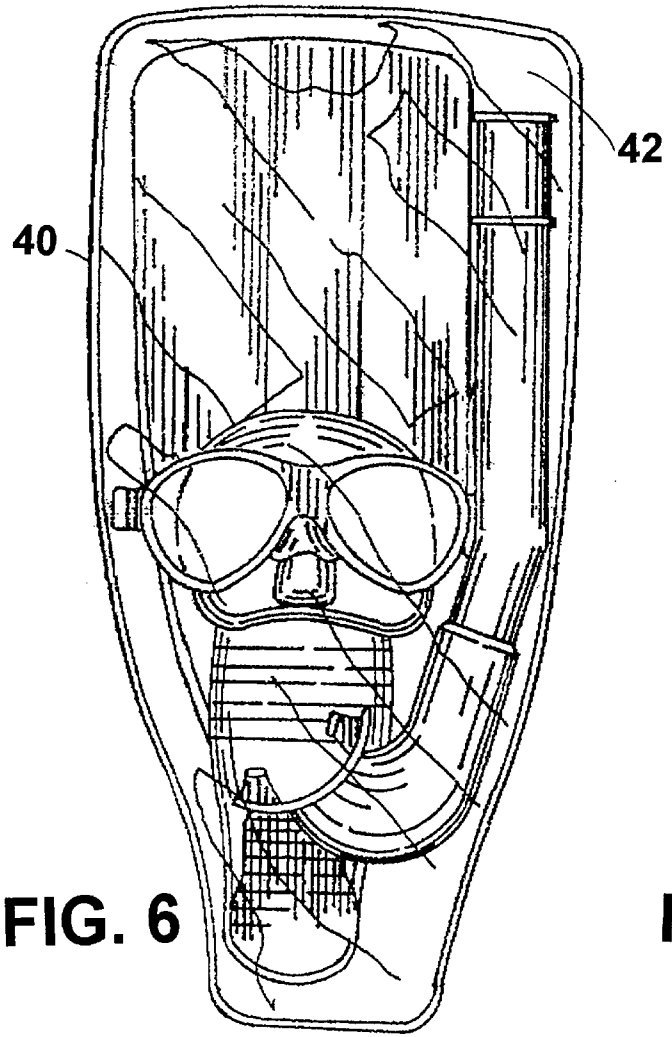
FIG. 6 is an elevational view of the completed package of the invention.

FIGS. 6 and 7 illustrate the final two steps in the method of the present invention. In FIG. 6, the assembled set of components of FIG. 5 has been placed into a zippered see-through plastic bag 40 with the plastic 42 being at least in front of the set of components to permit observation of the contents. Bag 40 is preferably slightly tapered to be narrower at the bottom (where the foot portions of fins 30 are located) than at the top so that it may readily accommodate the wider ends of the fins. In FIG. 7, an optional carton 5 is placed on the zippered bag 40. Carton 50 is deemed optional because the packaging method herein could be satisfactorily terminated with the zippered bag configuration of FIG. 6. However, if one wishes to provide a suitable surface for graphics and to stabilize the bag, one may place the zippered bag 40 into a carton 50 having end caps 52 and 56 separated by a spine 54 but leaving the majority of the front of bag 40 open to view as shown in FIG. 7.

Having thus disclosed a preferred embodiment of the invention, it being understood that the illustrated package and associated method are only exemplary and not necessarily limiting of the scope of protection hereof, what is claimed is:

1. A method of packaging a set of snorkel components including a mask having a face portion with at least one lens and having a strap; a snorkel tube having a lower portion with a mouthpiece and having an upper portion; and a pair of swim fins, each fin having a foot portion with an aperture for receiving the foot of a snorkeler; the method comprising the following steps:

a) placing said pair of swim fins in parallel overlapping engagement with their respective shoe portions substantially aligned;

b) locating the mask on said swim fins with the face portion oriented in substantially the same direction as said fin apertures;

c) positioning said snorkel tube along adjacent elongated edges of said swim fins with the mouthpiece of said snorkel tube being substantially adjacent said mask; and d) enclosing said mask, snorkel tube and swim fins in at least a partially transparent container.

2. The method recited in claim 1 wherein step b) further comprises the step of encircling said mask strap around said fins for substantially securing said mask to said fins.

3. The method recited in claim 1 wherein step b) further comprises the step of placing said mask about half-way along the length of said swim fins.

4. The method recited in claim 2 wherein said step of encircling comprises the step of tightening said strap around said fins.

5. The method recited in claim 4 wherein said step of tightening comprises the step of employing a strap tightener to shorten the effective length of said strap.

6. The method recited in claim 1 wherein step c) further comprises the step of securing said snorkel tube to said mask.

7. The method recited in claim 6 wherein said securing step comprises the step of threading said mask strap around at least a part of said snorkel tube.

8. The method recited in claim 1 further comprising the step of inserting at least a portion of said partially transparent container in a carton without covering at least a portion of the container through which the mask, snorkel tube and swim fins may be observed.

9. In combination, a set of snorkel components, comprising a mask having a strap and a face portion, a snorkel tube and a pair of swim fins each having a shoe portion, and a container enclosing said set of components for efficient shipping and display; the snorkel components being configured so that the swim fins are in parallel overlapping engagement with respective shoe portions substantially aligned; the mask is positioned on the fins with the mask's face portion oriented on the shoe portion side of said fins and the mask strap encircling said fins; the snorkel tube is positioned along adjacent elongated edges of the swim fins; and wherein said container is a partially transparent plastic container and wherein the mask, snorkel tube and swim fins are all visible through said container.

10. The combination recited in claim 9 further comprising a strap tightener for reducing the effective length of said strap for securing said mask to said swim fins.

11. The combination recited in claim 9 wherein said strap is secured to said snorkel tube.

12. The combination recited in claim 9 further comprising a carton having a pair of caps interconnected by a spine, said caps receiving opposing ends of said container.

13. The combination recited in claim 9 wherein said container comprises a carrying bag for said set of components.

* * * * *